US005727392A

United States Patent [19]

Matté

[11] Patent Number: 5,727,392

[45] Date of Patent: Mar. 17, 1998

[54] CONVECTION-SHIELDED CRYOPUMP

[75] Inventor: Stephen R. Matté, Norfolk, Mass.

[73] Assignee: Helix Technology Corporation, Mansfield, Mass.

[21] Appl. No.: 773,816

[22] Filed: Dec. 19, 1996

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,103,108 | 9/1963 | Santeler | 62/55.5 |
| 3,122,896 | 3/1964 | Hickey | 62/259 |
| 3,321,927 | 5/1967 | Hood | 62/55.5 |
| 4,577,465 | 3/1986 | Olsen et al. | 62/55.5 |
| 4,815,303 | 3/1989 | Duza | 62/55.5 |
| 5,156,007 | 10/1992 | Bartlett et al. | 62/55.5 |
| 5,465,584 | 11/1995 | Mattern-Klosson et al. | 62/55.5 |
| 5,537,833 | 7/1996 | Matté et al. | 62/55.5 |

*Primary Examiner*—Ronald C. Capossela
*Attorney, Agent, or Firm*—Hamilton, Brook, Smith & Reynolds, P.C.

[57] ABSTRACT

A cryopump includes a refrigerator, a heat station cooled by the refrigerator, and a cryopanel mounted to the heat station. The cryopanel and at least part of the heat station are within a chamber defined by a chamber wall. A shield extends from the chamber and surrounds the cryopanel to minimize the convective flow of gas past the cryopanel.

11 Claims, 3 Drawing Sheets

CONVECTION-SHIELDED CRYOPUMP

BACKGROUND OF THE INVENTION

Cryopumps are used to create exceptionally-low-pressure vacuum conditions by condensing or adsorbing gas molecules onto low-temperature cryopanels cooled by cryogenic refrigerators. Commonly, refrigerators used in this context are designed to perform a Gifford-McMahon cooling cycle. These refrigerators generally include one or two stages, depending upon which gases are sought to be removed from the controlled atmosphere. Two-stage refrigerators are used when removal of low-condensing-temperature gases is desired. The second stage is typically operated at approximately 15 to 20K to condense gases such as argon, nitrogen and oxygen upon a cryopanel thermally coupled to the second stage.

In contrast, a single-stage cryopump is typically operated between 90 and 120K. Operating within this temperature range, a single-stage cryopump will effectively remove gases, such as water, which achieve nearly complete condensation at temperatures below 120K.

One application where single-stage cryopumps have found frequent use is in process tools designed for the manufacture of semiconductors. A diagram of a cluster process tool is provided as FIG. 1. The process tool 100 typically includes a plurality of inter-connected chambers including an entrance load lock 102 and an exit load lock 104. Each of the load locks 102 and 104 includes a pair of slidable doors 106 and 107. An exterior door 106 opens to the outside atmosphere, and an interior door 107 opens to a transfer chamber 108 which serves as the hub of the process tool 100. Process chambers 112, where manufacturing processes such as etching are performed, open to the transfer chamber 108 along its periphery. Within the process tool 100, an arm 110 rotates to transfer elements among the chambers. Each of these chambers is maintained under vacuum.

In a typical operation of the process tool 108, the exterior door 106 of the entrance load lock 102 opens, venting the entrance load lock 102 to a warm rush of air at ambient pressure and temperature. Semiconductor wafers are inserted into the lock 102, and the exterior door 106 is closed. A rough pump non-selectively evacuates the air within the load lock 102 while a cryopump 114 selectively condenses water vapor and other high-condensing-temperature gases. The dual action of these pumps reestablishes vacuum conditions within the load lock 102. When the pressure within the entrance load lock 102 has returned to a sufficiently low level, the interior door 107 opens, and the rotating arm ! 10 removes the wafers from the load lock 102 and sequentially delivers and retrieves them from each of the processing chambers 112. The ultra-low vacuum within those chambers is maintained by additional vacuum pumps including a two-stage cryopump. Upon completion of processing, the wafers are delivered to the exit load lock 104. Like the entrance load lock 102, the exit load lock 104 is vented when the exterior door 106 is opened to retrieve the wafers; and a rough pump and a cryopump 114 return the load lock 104 to vacuum conditions to prevent an influx of gas into the transfer chamber 108 when the interior door 107 is later reopened for the next transfer of wafers.

SUMMARY OF THE INVENTION

When a load lock is vented to the outside atmosphere, the load lock is flooded with warm gas. As a result, vast quantities of room-ambient gases are cooled by the cryopanel. The cooled gases typically pour off of the cryopanel to the floor of the load lock creating convective currents. These currents sweep the cooled gases through the load lock and create a fluid circuit of warmer gas circulating across the surface of the cryopanel, thereby exacerbating the rate of cryopanel warming and fueling the convective current flow. Further, the convective circulation produces significant condensation on the underside of the cryopanel, which often produces undesirable consequences because gases released as liquids from this position may be difficult to contain.

In an apparatus remedying these problems, a cryopump includes a refrigerator, a heat station cooled by the refrigerator, and a cryopanel mounted to the heat station. The heat station is at least partially within the chamber defined by a chamber wall. A shield surrounds the cryopanel and extends from the chamber wall to minimize the convective flow of gas past the cryopanel.

In a preferred embodiment, the chamber is a load lock; the refrigerator is a single-stage cold finger; and the cryopanel is trough-shaped. Moreover, insulating spacers are used to prevent direct contact between the shield and the cryopump. The spacers maintain the small separation between the shield and the cryopump necessary to minimize convection within the shield and condensation on the underside of the panel.

A vacuum vessel may surround the refrigerator cold finger outside the load lock. This vacuum vessel is mounted to both the chamber wall and a flange on the cryopump. The volume enclosed by the vessel is in fluid communication with the load lock.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily drawn to scale, emphasis instead being placed upon illustrating the principles of the invention.

DETAILED DESCRIPTION OF PREFERRED EMBODIMENTS

Figure 1:
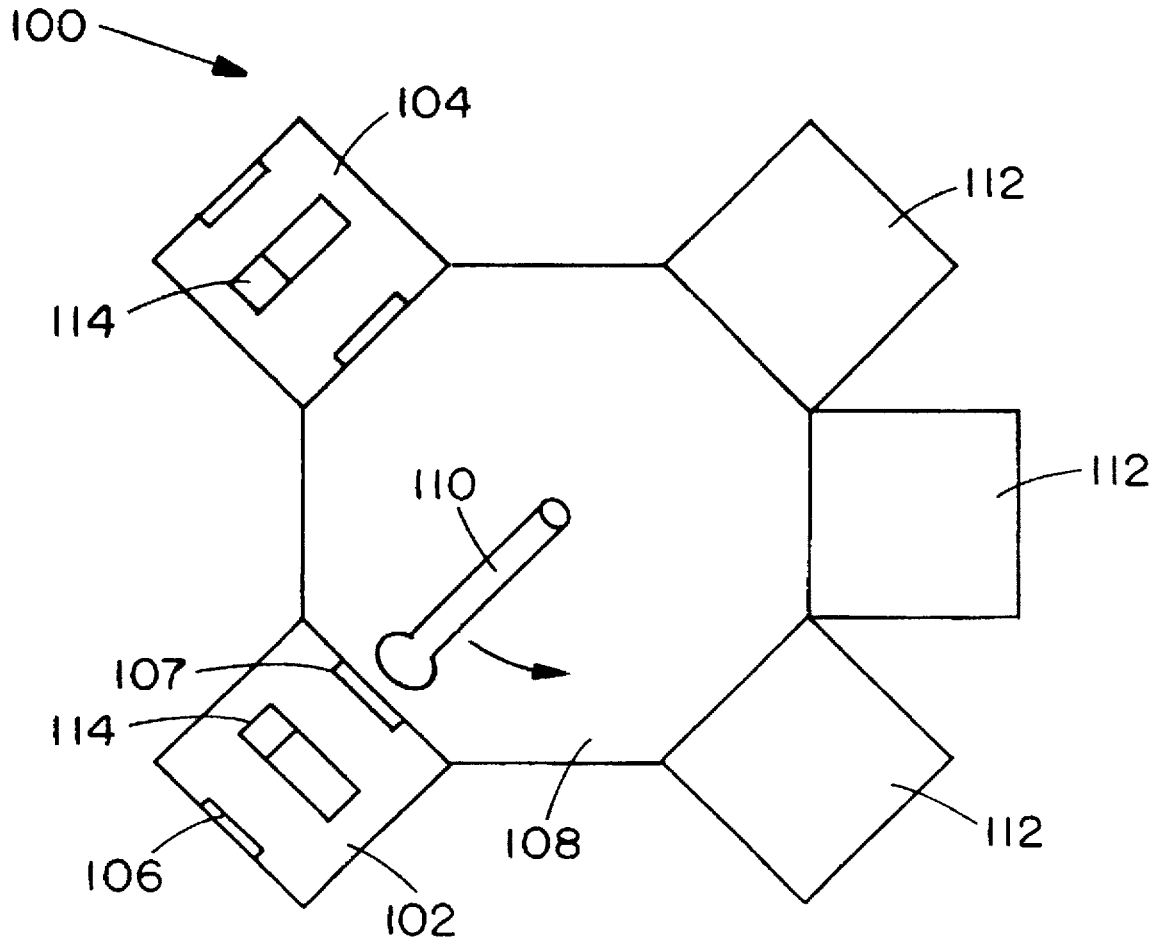
FIG. 1 is a cross-sectional overhead view of a process tool.
Figure 2:
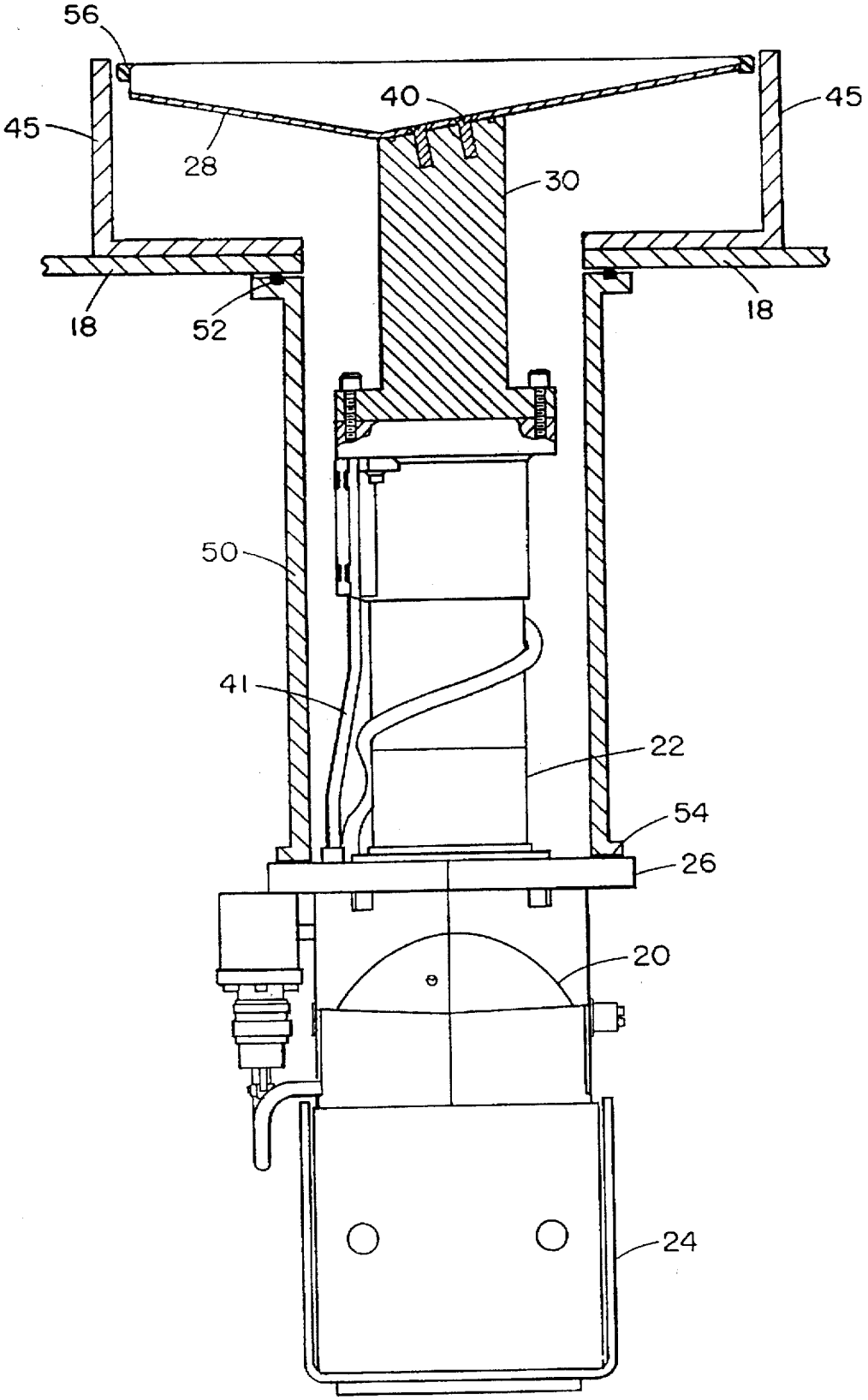
FIG. 2 is a side view, partially in cross section, of an apparatus including a single-stage cryopump, a chamber wall and a shield embodying the present invention.

A cross-sectional view of a single-stage cryopump projecting into a chamber is shown in FIG. 2. A shield 45 reduces both convective heat transfer to the cryopump and the condensation of gases on the underside of the cryopanel. This single-stage cryopump is particularly suited to the capture of water vapor within a load lock. The single-stage cryopump is mounted to a vacuum vessel 50 through a flange 26. The vacuum vessel 50, in turn, is mounted to a chamber wall 18, whereby the refrigerator extends through the vacuum vessel 50, through the chamber wall 18 and into the load lock. An O-ring 52 is placed between the vacuum vessel 50 and the chamber wall 18 to provide a seal. At the opposite end of the vacuum vessel 50, a seal 54 is used between the vacuum vessel 50 and the flange 26. The refrigerator includes a cold finger 22, which is shown outside of the chamber but may alternatively project into the chamber. In thermal contact with the external cold finger 22, a thermally-conductive post 30, preferably of copper or aluminum, extends the refrigerator heat station and projects into the chamber. A cryopanel 28 is mounted to the thermally-conductive post 30 within the chamber. For corrosive environments, the post and cryopanel are of coated metal as set forth in U.S. patent application Ser. No. 08/708,451, incorporated herein by reference.

Figure 3:
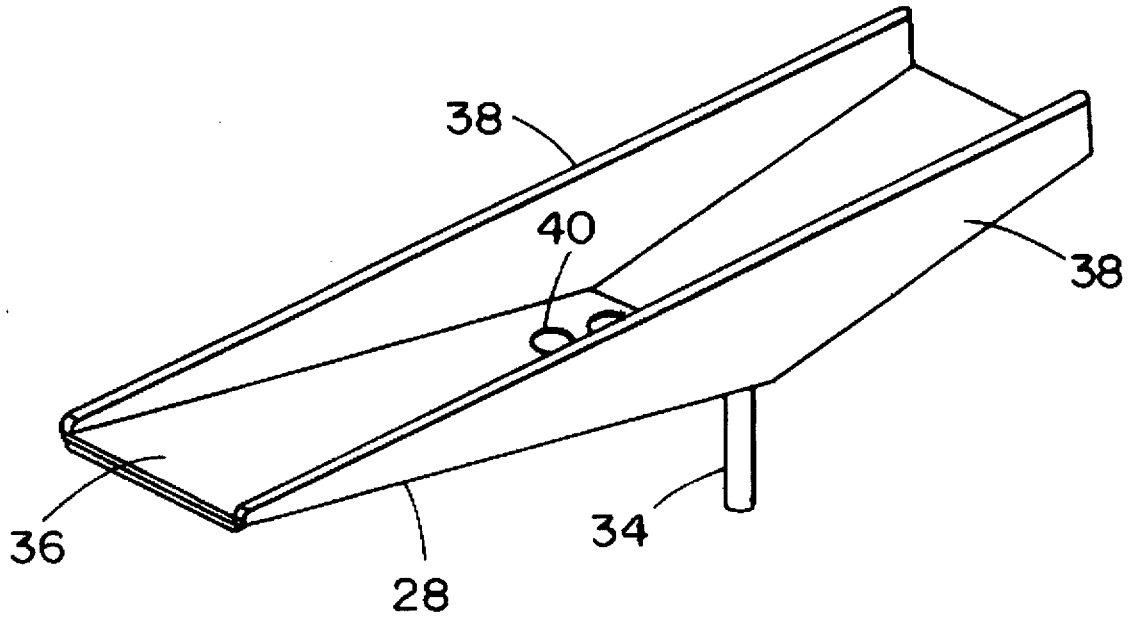
FIG. 3 is a perspective view of the cryopanel of the single-stage cryopump of FIG. 2.

The cryopanel 28 is typically comprised of copper or aluminum and is formed as a trough, illustrated more particularly in FIG. 3, in order to collect elements that have liquefied upon warming and to direct the liquid down a drain tube 34 at the bottom of the trough 28. The trough 28 includes a simple V-shaped base 36 and sidewalls 38. The V is asymmetric to provide a flat surface on which bolt holes 40 are provided for mounting the trough 28 to the thermally-conductive post 30 which acts as a heat station.

The single-stage refrigerator includes a motor 20 for driving a displacer within the cold finger 22 through a Gifford-McMahon refrigeration cycle. The system is controlled by electronics 24, which in this system are integral with the cryopump assembly. Among other functions, the electronics 24 regulate a heater 41 which is operated to maintain a desired temperature. In a preferred single-stage cryopump application, that temperature is 107K.

As shown in FIG. 2, a shield 45 provides a barrier surrounding those sections of the cryopump extending into the chamber. The shield 45 thereby restricts flow past the cryopanel to minimize convective currents which can develop around the cryopump. By minimizing currents, warming of the cryopanel is reduced as is the formation of condensation on the underside of the cryopanel where it cannot access the drain tube 34.

Minimizing the volume between the shield and the cryopump provides the added benefit of not only preventing the convective flow throughout the chamber, but also preventing secondary convective currents from forming between the cryopump and the shield. Therefore, the distance between the shield and the cryopump is preferably kept to a minimum.

Insulating spacers 56 are mounted between the shield 45 and the cryopump to prevent the shield 45 from contacting cold sections of the cryopump. Contact is preferably avoided because the shield 45 is not cooled by the refrigerator or other direct means. Therefore, incidental contact could flood the cryopump with unwanted thermal energy during normal operation.

In essence, the shield 45 forms a well around the cryopanel 28. The shield 45 is shaped to the design of the cryopump that it surrounds and includes an orifice through which the cryopump can pass. The shield rests upon the interior of the chamber wall 18 and extends upward. When gas is cooled by the cryopanel, it will flow into the annular passage between the cryopump and the shield 45, where the gas will remain cool. The confinement created by the shield 45 prevents the cooled gas from spreading across the floor of the chamber, a motion that the gas is otherwise inclined toward because of its comparatively-lower temperature and greater density. By confining the horizontal spread of the gas, the creation of convection currents is greatly reduced.

Accordingly, a vertical orientation of the shield at the bottom of the chamber provides the important advantage of channeling the cooled gas along its natural direction of flow into a small enclosure defined primarily by the shield 45 and the chamber wall 18. The gas within that small enclosure remains cool with minimal convective flow, thus minimizing heating of the cryopump. Also, flow of that cool gas along the floor of the chamber is blocked by the shield so that it does not contribute to the overall convective flow in the larger load lock chamber. In this embodiment, the only cold surface openly exposed to the chamber is the horizontal cryopanel facing upward. From this position, near the base of the chamber, the cryopanel is well-positioned to capture condensing gases. Further, because convective currents are created primarily when cold gas sinks along a vertical surface without confinement, the most culpable source of convection is openly-exposed, cold, vertical surfaces. By enclosing all such surfaces within the shield, the embodiments of this invention significantly reduce convective flow across the cryopump.

I claim:

1. A cryopump apparatus comprising:

a chamber wall defining a boundary of a chamber;

a cryopump including a refrigerator, a heat station cooled by the refrigerator and at least partially within the chamber, and a cryopanel mounted onto the heat station within the chamber; and a shield mounted on the chamber wall and surrounding the cryopanel, the shield minimizing convective flow of gas past the cryopanel.

2. The cryopump apparatus of claim 1, wherein the refrigerator is a single-stage cold finger.

3. The cryopump apparatus of claim 2, wherein the chamber is a load lock.

4. The cryopump apparatus of claim 3, wherein the cryopanel is trough-shaped.

5. The cryopump apparatus of claim 4, further comprising at least one insulating spacer providing a barrier to direct contact between the cryopump and the shield.

6. The cryopump apparatus of claim 5, further comprising a vacuum vessel surrounding the cold finger to the extent that the cold finger extends outside the load lock, wherein the vacuum vessel is mounted to both the chamber wall and a flange on the cryopump, and wherein the vacuum vessel surrounds a volume in fluid contact with the load lock.

7. A cryopump apparatus comprising:

a chamber wall defining the edge of a load lock;

a cryopump projecting into the load lock, the cryopump including:

a cold finger;

a thermally-conductive post having two ends, wherein a first end is mounted to, and in thermal contact with the cold finger, and wherein the post projects at least partially into the chamber; and a cryopanel mounted to a second end of the thermally-conductive post, wherein the cryopanel is within the load lock; and a shield radially surrounding the cryopump and mounted to the chamber wall.

8. The cryopump apparatus of claim 7, further comprising at least one insulating spacer to prevent direct contact between the shield and the cryopump.

9. The cryopump apparatus of claim 8, wherein the cryopanel is trough-shaped.

10. A cryopump and surrounding shield unit comprising:

a single-stage cryopump including a trough-shaped cryopanel;

a shield surrounding the cryopanel; and at least one insulating spacer positioned between the cryopump and the shield to prevent direct contact between the cryopanel and the shield.

11. A method for assembly an apparatus for minimizing convective flow of gas past a cryopanel comprising:

projecting a single-stage cryopump through a floor of a load lock; and placing a shield on the floor of the load lock, the shield surrounding the single-stage cryopump.

* * * * *